US007377858B2

(12) United States Patent
Kubota

(10) Patent No.: US 7,377,858 B2
(45) Date of Patent: May 27, 2008

(54) PUTTER HEAD

(75) Inventor: Makoto Kubota, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 335 days.

(21) Appl. No.: 11/185,682

(22) Filed: Jul. 21, 2005

(65) Prior Publication Data

US 2006/0019766 A1 Jan. 26, 2006

(30) Foreign Application Priority Data

Jul. 21, 2004 (JP) ..... P2004-213345

(51) Int. Cl.
*A63B 69/36* (2006.01)
*A63B 53/04* (2006.01)

(52) U.S. Cl. ..... 473/251; 473/340; 473/252; 273/DIG. 14

(58) Field of Classification Search ..... 473/219–256, 473/340–341; D21/736–746, 751; 273/DIG. 14
See application file for complete search history.

(56) References Cited

U.S. PATENT DOCUMENTS

| | | | | |
|---|---|---|---|---|
| 1,291,967 | A * | 1/1919 | McDougal | 473/251 |
| 2,520,950 | A * | 9/1950 | Miller | 473/242 |
| 3,134,596 | A * | 5/1964 | Boznos | 473/250 |
| 4,199,144 | A | 4/1980 | Skelly | |
| 4,369,974 | A * | 1/1983 | Komperda | 473/250 |
| 4,411,430 | A | 10/1983 | Dian | |
| 4,714,252 | A * | 12/1987 | Roraback | 473/338 |
| 5,433,444 | A * | 7/1995 | Chiuminatta et al. | 473/240 |
| 5,839,974 | A | 11/1998 | McAllister | |
| 6,478,694 | B2 * | 11/2002 | Anderson et al. | 473/350 |
| 7,022,030 | B2 * | 4/2006 | Best et al. | 473/340 |
| 2005/0159241 | A1 * | 7/2005 | Hou | 473/340 |

FOREIGN PATENT DOCUMENTS

| | | | |
|---|---|---|---|
| JP | 9-38247 | A | 2/1997 |
| JP | 10-127833 | A | 5/1998 |
| JP | 2001-9072 | A | 1/2001 |
| JP | 2003-339926 | A | 12/2003 |
| JP | 2004-16776 | A | 1/2004 |

* cited by examiner

*Primary Examiner*—Sebastiano Passaniti
(74) *Attorney, Agent, or Firm*—Sughrue Mion, PLLC

(57) ABSTRACT

A putter head includes a face portion, at least one first aiming marker, and a contrast portion. The first aiming marker appears substantially parallel to a face surface of the face portion. The contrast portion substantially contrasts with the first aiming marker in appearance. The contrast portion is disposed adjacent to the face portion.

14 Claims, 5 Drawing Sheets

PUTTER HEAD

BACKGROUND OF THE INVENTION

1. Field of the Invention

The invention relates to a putter head and, more particularly, to a putter head, which is easily set in a position and is superior in stability at impact.

2. Description of the Related Art

It is important in putting in golf to align a face surface square to a putting line (hereunder, this operation may be referred to as a "setting of a putter head to a line" square to the putting line). Usually, the "setting of the face to the line" is visually performed. However, face surfaces of some putter heads are easy to be aligned square to the putting line, and others are not, depending upon the shapes of the putter heads. Specifically, the more clearly lines parallel and perpendicular to the face surface is visible on the putter head, the more easily the "setting of the putter head to the line" is achieved. Representative examples of such a putter head are what are called an L-shaped putter head and a T-shaped putter head (for example, see JP 2001-9072 A).

Further, in the field of a golf putter, great importance is attached to the stability at impact. To enhance the stability at impact, generally, the width of the sole of the head and the depth of the center of gravity thereof are increased thereby to enlarge the sweet area thereof and to increase the moment of inertia thereof. A representative example of a putter head, whose stability at impact is enhanced by such means, is what is called a mallet putter head (see, for example, JP Hei. 9-38247 A).

Further, recently, there has been used a putter head of an unusual shape, which does not belong to the aforementioned categories, such as the L-shaped type, the T-shaped type, and the mallet type. A representative example of the putter head of the unusual shape is what is called a two-ball type putter head (for instance, see JP 2003-339926 A).

SUMMARY OF THE INVENTION

However, the L-shaped putter head and the T-shaped putter head as disclosed in JP 2001-9072 A are small in the sweet area and in the moment of inertia. Thus, the L-shaped putter head and the T-shaped putter head are inferior in the stability at impact. Consequently, it is difficult for beginners and intermediate-level golfers to use the L-shaped putter head and the T-shaped putter head. Further, in the mallet putter head as disclosed in JP Hei. 9-38247 A, it is frequent that the shapes of the sides and the back thereof are close to circular arcs. Thus, lines parallel and perpendicular to the face surface thereof are not clearly visible. Consequently, it is difficult to achieve the "setting of the putter head to the line". Furthermore, the putter head of the unusual shape type as disclosed in JP 2003-339926 A has an unusual shape and are unacceptable to many golfers due to the appearance thereof. Additionally, lines parallel and perpendicular to the face surface thereof are not clearly visible, similarly to the mallet putter head. Besides, hitherto, there has hardly been proposed a putter head enabled to achieve both the ease of performing the "setting of the putter head to the line" and the stability at impact.

The invention has been made in view of the aforementioned circumstances. Accordingly, the invention provides a putter head, which facilitates "setting of the putter head to the line" and is superior in the stability at impact.

According to one embodiment of the invention, a putter head includes a face portion, at least one first aiming marker, and a contrast portion. The first aiming marker appears substantially parallel to a face surface of the face portion. The contrast portion substantially contrasts with the first aiming marker in appearance. The contrast portion is disposed adjacent to the face portion.

According to this structure, the putter head includes first the at least one first aiming marker appears substantially parallel to a face surface of the face portion and the contrast portion substantially contrasts with the first aiming marker in appearance. Therefore, the aiming marker appears clearly. Accordingly, it is easy for a golfer to aligning the face surface to be perpendicular to a putting line.

According to one embodiment of the invention, when viewed from above the putter head, the at least one first aiming marker appears substantially parallel to the face surface of the face portion. Also, the first aiming maker may be formed on the face portion. The contrast portion may appear substantially transparent. A light transmission of the contrast portion may be equal to or larger than 70%. When viewed from above the putter head, the contrast portion may be seen through. The face portion may be made of metal. No opaque portion may be present on each side of the contrast portion. The contrast portion may be disposed behind the face portion.

If the contrast portion is disposed behind the face portion, a depth of the center of gravity of the putter head increases due to weight of the contrast portion, and also moment of inertia of the putter head increases. As a result, stability of the putter head at impact is improved.

The putter head may further include a back portion disposed behind the contrast portion. According to this structure, the depth of the center of gravity further increases. Also, the moment of inertia further increases. Thus, the stability of the putter head at impact can be further improved.

Further, the putter head may further include at least one second aiming marker, which appears substantially perpendicular to the face surface of the face portion. This structure further facilitates aligning the face surface to be perpendicular to the putting line.

Furthermore, if dimension and specific gravity of each portion meet the following relations (a) to (c), the "setting of the putter head to the line" is further facilitate and the stability of the putter head at impact is further improved.

(a) The face portion meets a relation:

$$L \geqq DT \geqq 0.5 \times L \quad (1)$$

where L represents a length of the face surface of the face portion in a toe-and-heel direction and DT represents a total width of the putter head in a front-and-back direction.

(b) The face portion, the contrast portion and the back portion meet a relation:

$$D2 > D1 \quad (2)$$

$$D2 > D3 \quad (3)$$

where D1 represents a width of the face portion in a in a front-and-back direction, D2 represents a width of the contrast portion in the front-and-back direction, and D3 represents a width of the back portion in the front-and-back direction. (incidentally, the inequality (3) is applied only when the putter head includes a back portion).

(c) The face portion, the transparent portion and the back portion meet a relation:

$$\rho 1 > \rho 2 \quad (4)$$

$$\rho 3 \geqq \rho 1 \quad (5)$$

where ρ1 represents a specific gravity of a material of the face portion, ρ2 represents a specific gravity of a material of the transparent portion, and ρ3 represents a specific gravity of a material of the back portion (incidentally, the inequality (5) is applied only when the putter head includes a back portion).

Specifically, according to one embodiment, the length L of the face surface of the face portion may be in a range of from 90 mm to 150 mm, preferably, from 100 mm to 120 mm. Also, the total width DT of the putter head may be in a range of from 70 mm to 140 mm, preferably, from 80 mm to 110 mm. The width D1 of the face portion may be in a range of from 10 mm to 40 mm, preferably, from 15 mm to 30 mm. The width D2 of the contrast portion may be in a range of from 20 mm to 125 mm, preferably, from 33 mm to 87 mm. The width D3 of the back portion may be in a range of from 5 mm to 20 mm, preferably, from 8 mm to 17 mm. The specific gravity ρ1 of the face portion may be in a range of from 1.5 g/cm$^3$ to 9.0 g/cm$^3$, preferably, from 1.7 g/cm$^3$ to 8.0 g/cm$^3$. The specific gravity ρ2 of the contrast portion may be in a range of from 0.5 g/cm$^3$ to 4.0 g/cm$^3$, preferably, from 1.0 g/cm$^3$ to 2.6 g/cm$^3$. The specific gravity ρ3 of the back portion may be in a range of from 2.5 g/cm$^3$ to 19.3 g/cm$^3$, preferably, from 7.8 g/cm$^3$ to 18.5 g/cm$^3$.

A light transmission member forming the contrast portion may have a light transmission equal to or larger than 70%, preferably equal to or larger than 85%. This structure extremely facilitates the "setting of the putter head to the line" utilizing the face portion.

Further, the depth of the center of gravity (a distance between the face surface of the face portion and a center of gravity of the putter head) may be equal to or larger than 20 mm, preferably equal to or larger than 25 mm. This structure surely enlarges the sweet area. Thus, the stability of the putter head at impact can be improved.

For example, iron, stainless steel, titanium, aluminum, magnesium, and alloys thereof may be used as a material of the face portion. For instance, transparent resins such as a polycarbonate resin, an acrylate (or methacrylate) resin, an ABS resin, a styrene based resin, a butadiene-styrene based resin, a butadiene-styrene copolymer and a methacrylate-styrene copolymer, and glass may be used as a material of the contrast portion. Especially, a polycarbonate resin is preferable as a material of the contrast portion because a polycarbonate resin has high optical transparency, good impact resistance and good weather resistance. For example, iron, stainless steel, tungsten, copper, aluminum, and alloys thereof may be used as a material of the back portion.

The putter head of the invention easily achieves the "setting of the putter head to the line", more specifically, is easily set in a position where the face portion is aligned to be perpendicular to the putting line, and also is superior in the stability at impact.

DETAILED DESCRIPTION OF THE EMBODIMENTS

Figure 1:
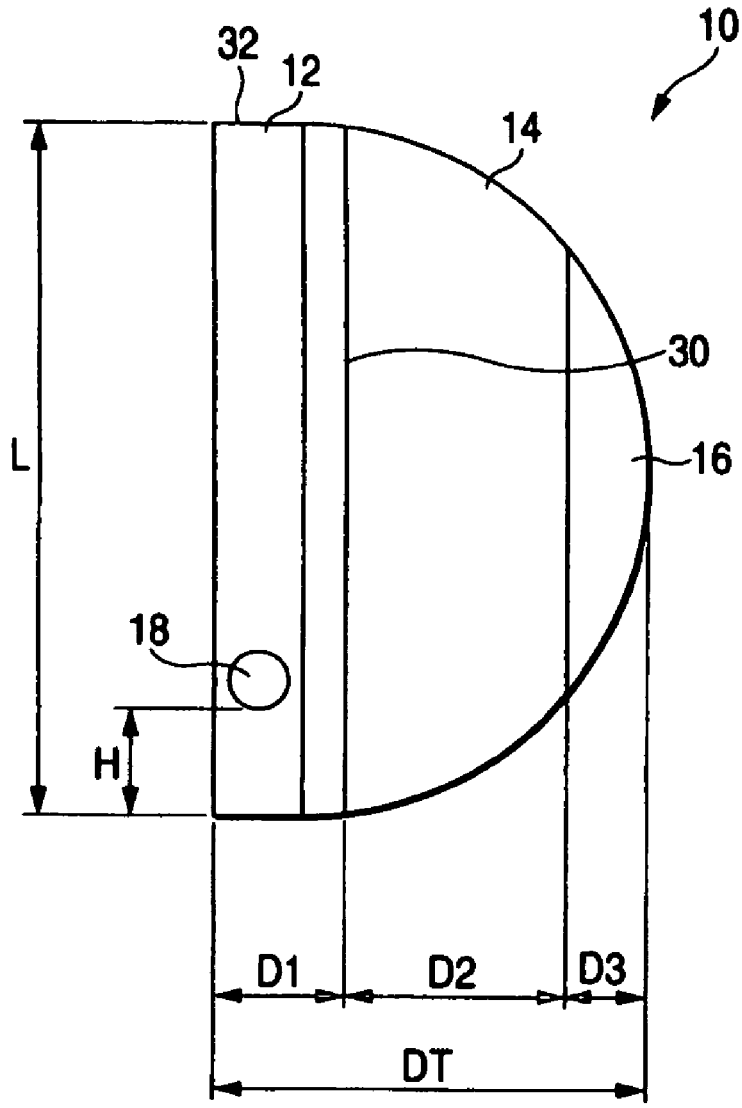
FIG. 1 is a plan view illustrating a putter head according to an embodiment of the invention.
Figure 2:
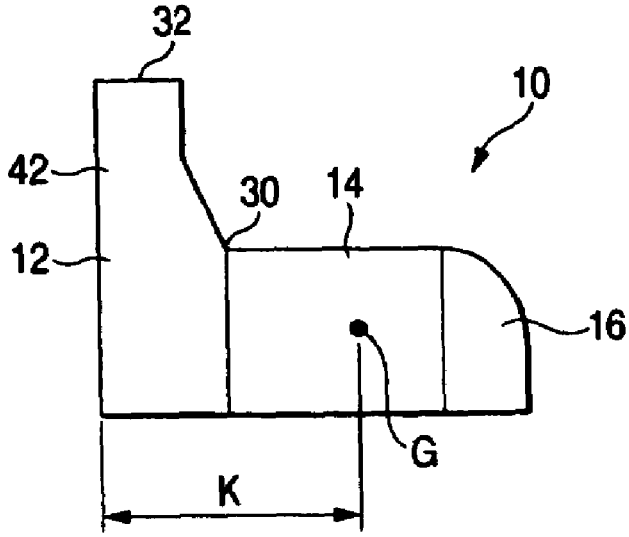
FIG. 2 is a side view of the putter head shown in FIG. 1.

Hereinafter, embodiments of the invention are described with reference to the accompanying drawings. However, the invention is not limited to the following embodiments. FIG. 1 is a plan view illustrating a putter head according to an embodiment of the invention. FIG. 2 is a side view of the putter head.

The putter head 10 of this embodiment includes a face portion 12, a transparent portion 14 (serving as a contrast portion), and a back portion 16. The face portion 12 is made of soft iron and it has a substantially rectangle shape in plan view. The transparent portion 14 is fixed to a rear end of the face portion 12 by adhesion and it is made of a polycarbonate based transparent resin. The back portion 16 is fixed to a rear end of the transparent portion 14 by adhesion and it is made of tungsten alloy. When viewed from above the putter head 10, the face portion 12 appears to have (a) a line (serving as a first aiming marker) parallel to the face surface thereof and (b) a line (serving as a second aiming marker) perpendicular to the face surface. Further, in the figures, reference numeral 18 designates a hosel hole defined in the top surface of the face portion 12. The putter head 10 of this embodiment has a substantially semicircular shape in plan view. Further, the height of the face portion 12 is higher than those of the transparent portion 14 and the back portion 16. Furthermore, the transparent portion 14 and the back portion 16 are equal in height to each other.

The dimensions and the specific gravities of each portion of the putter head 10 of this embodiment meet the aforementioned relations (a) to (c). Specifically, the length L of the face surface of the face portion 12 is 110 mm in the toe-and-heel direction. The total width DT of the putter head 10 is 90 mm in the front-and-back direction. The width D1 of the face portion 12 is 25 mm in the front-and-back direction. The width D2 of the transparent portion 14 is 55 mm in the front-and-back direction. The width D3 of the back portion 16 is 10 mm in the front-and-back direction. The specific gravity ρ1 of a material of the face portion 12 is 2.7 g/cm$^3$. The specific gravity ρ2 of a material of the transparent portion 14 is 1.2 g/cm$^3$. The specific gravity ρ3 of the material of the back portion 16 is 18.0 g/cm$^3$. The depth K of the center of gravity (that is, a distance from the face surface to the center G of gravity shown in FIG. 2) is 33 mm.

In the putter head 10 of this embodiment, an optical reflectance of the top surface of the face portion 12 is higher than that of the top surface of the back portion 16. Consequently, the face portion 12 is more noticeable than the back portion 16. This facilitates the "setting of the putter head to the line." In this case, a method of changing the optical reflectances of the top surfaces of the face portion 12 and back portion 16 may include, for example, performing different finish grinding methods on both the portions 12 and 16, respectively.

Figure 7:
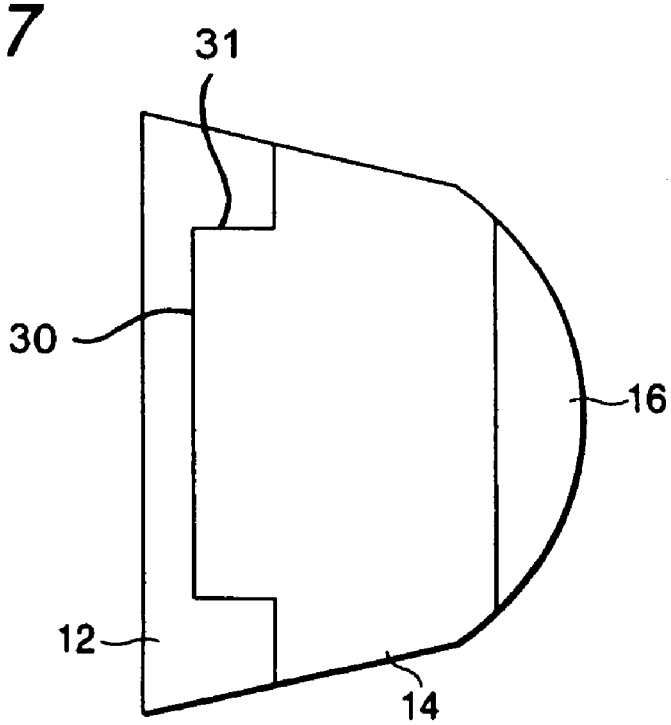
FIG. 7 is a plan view illustrating a putter head according to another embodiment of the invention.

In the putter head 10 of this embodiment, due to the existence of the transparent portion 14, the lines 30 and 31 (for example, as shown in FIG. 7), which are respectively parallel and perpendicular to the face surface of the face portion 12, are clearly visible at putting. This facilitates the "setting of the putter head to the line." In this case, the outer contours (that is, the outer edges) of the transparent portion 14 are obscure. Also, due to the existence of the transparent portion 14 and back portion 16, the depth K of the center of gravity increases. Consequently, the moment of inertia increases. Thus, the putter head of this embodiment is superior in the stability at impact.

For example, the putter head of the embodiment described above may be modified as follows.

Figure 3:
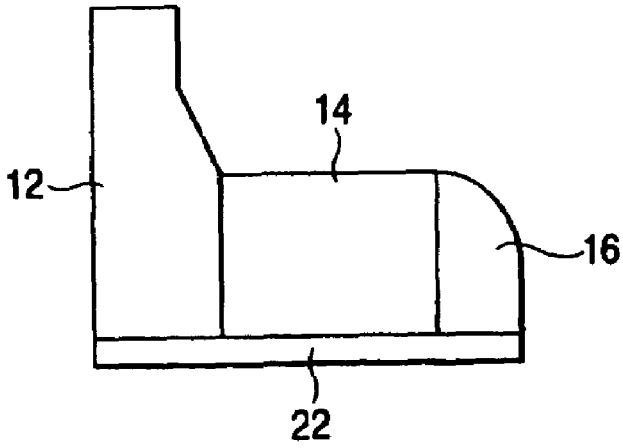
FIG. 3 is a side view illustrating a putter head according to another embodiment of the invention.

(1) Like a putter head shown in FIG. 3, a support plate 22 made of an optical transparent material such as a polycarbonate based transparent resin may be fixed to the bottom of the putter head.

Figure 4:
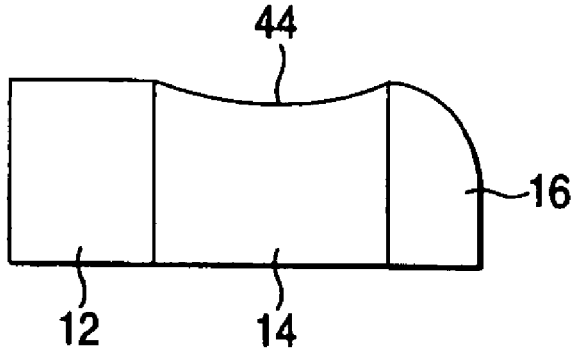
FIG. 4 is a side view illustrating a putter head according to another embodiment of the invention.

(2) Like a putter head shown in FIG. 4, a top blade (designated by reference numeral 42 in FIG. 2) of the face portion 12 may be eliminated. Also, the top surface of the transparent portion 14 may be formed as a concave surface (or a convex surface) 44.

Figure 5:
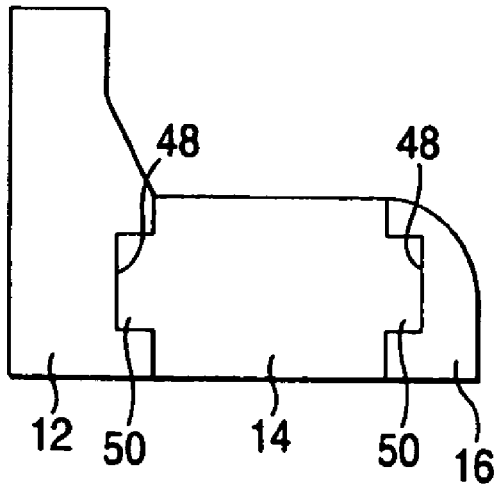
FIG. 5 is a side view illustrating a putter head according to another embodiment of the invention.

(3) Like a putter head shown in FIG. 5, concave portions 48 may be defined in the face portion 12 and the back portion 16, respectively. Also, convex portions 50 to be fitted to the concave portions 48 are formed in the transparent portion 14. Further, the convex portions 50 are fitted to the concave portions 48, respectively. Furthermore, the face portion 12, the transparent portion 14, and the back portion 16 are fixed by adhesion.

Figure 6:
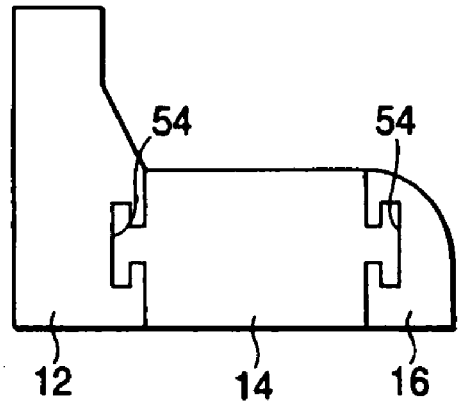
FIG. 6 is a side view illustrating a putter head according to another embodiment of the invention.

(4) Like a putter head shown in FIG. 6, the face portion 12 and the back portion 16 may be set in a die. Then, a liquid resin is injected therebetween. This resin is poured into groove portions 54 defined in the face portion 12 and the back portion 16, respectively. Thereafter, the resin is hardened. Thus, the face portion 12, the transparent portion 14, and the back portion 16 are fixed. Further, a method of manufacturing a transparent portion made of a transparent resin may include forming a block-like material into a desired shape by machining.

(5) Like a putter head shown in FIG. 7, the shape in plan view of the face portion 12 may be other than a rectangle. In this case, it is sufficient that at least one line parallel to the face is visible when the face portion 12 is viewed from above.

Figure 8:
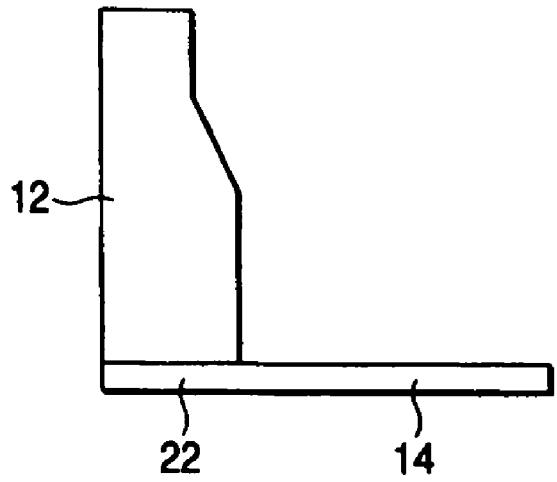
FIG. 8 is a side view illustrating a putter head according to another embodiment of the invention.

(6) Like a putter head shown in FIG. 8, the face portion 12 may be fixed to an upper front portion of the support plate 22 made of an optical transparent material such as a polycarbonate based transparent resin. Further, the remaining part of the support plate 22, to which the face portion 12 is not fixed, may be made of the transparent portion 14.

Figure 9:
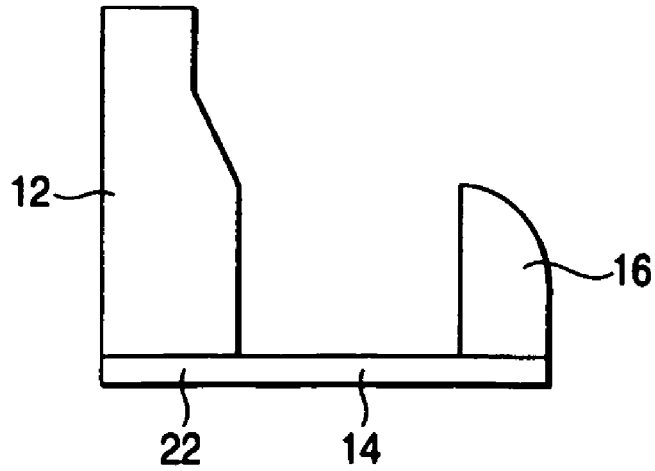
FIG. 9 is a side view illustrating a putter head according to another embodiment of the invention.

(7) Like a putter head shown in FIG. 9, the face portion 12 may be fixed to an upper front portion of the support plate 22 made of an optical transparent material such as a polycarbonate based transparent resin. Also, the back portion 16 is fixed to an upper rear portion of the support plate 22. Further, the remaining part of the support plate 22, to which the face portion 12 and the back portion 16 are not fixed, is constituted by the transparent portion 14.

(8) A low-hardness insert member, whose material is different from that of the face portion 12, may be mounted in the face of the face portion 12.

(9) A weight member, whose specific gravity is higher than that of the transparent portion 14, may be mounted on the transparent portion 14. Also, a weight member, whose specific gravity is higher than that of the back portion 16, maybe mounted on the back portion 16.

(10) The transparent portion 14 and the back portion 16 are colored in colors similar to the color of putting green, such as yellow, green, and yellowish green. Consequently, the face portion 12 is seen as if further emphasized.

(11) A shaft mounting neck portion may be provided instead of the hosel hole. It is preferable for facilitating the "setting of the putter head to the line" to set the positions of the hosel hole and the neck portion to be as much as close to the heel-side end of the head. Specifically, it is appropriate that as shown in FIG. 1, the distance H between the heel-side end portion of the head 10 and the hosel hole 18 or between the heel-side end portion and the neck portion is in a range of from 0 mm to 25 mm, especially, from 0 mm to 15 mm. Incidentally, the distance H between the heel-side end portion and the hosel hole does not become 0 mm.

What is claimed is:

1. A putter head comprising:

a face portion;

a contrast portion disposed adjacent to the face portion, wherein the contrast portion appears substantially transparent, wherein the contrast portion is disposed behind the face portion;

a back portion disposed behind the contrast portion; and at least one first aiming marker, which appears substantially parallel to a face surface of the face portion, the at least one aiming marker formed by a boundary between the face portion and the contrast portion;

wherein the face portion and the contrast portion meet a relation:

$$\rho 1 > \rho 2$$

where $\rho 1$ represents a specific gravity of a material of the face portion and $\rho 2$ represents a specific gravity of a material of the contrast portion.

2. The putter head according to claim 1, wherein:

when viewed from above the putter head, the at least one first aiming marker appears substantially parallel to the face surface of the face portion.

3. The putter head according to claim 1, wherein a light transmission of the contrast portion is equal to or larger than 70%.

4. The putter head according to claim 1, wherein when viewed from above the putter head, the contrast portion is seen through.

5. The putter head according to claim 1, wherein the face portion is made of metal.

6. The putter head according to claim 1, further comprising:

at least one second aiming marker, which appears substantially perpendicular to the face surface of the face portion.

7. The putter head according to claim 6, wherein when viewed from above the putter head, the second aiming marker appears substantially perpendicular to the face surface of the face portion.

8. The putter head according to claim 1, wherein the face portion meets a relation:

$$L \geqq DT \geqq 0.5 \times L$$

where L represents a length of the face surface of the face portion in a toe-and-heel direction and DT represents a total width of the putter head in a front-and-back direction.

9. The putter head according to claim 1, wherein the face portion and the contrast portion meet a relation:

$$D2>D1$$

where D1 represents a width of the face portion in a in a front-and-back direction and D2 represents a width of the contrast portion in the front-and-back direction.

10. The putter head according to claim 1, wherein the face portion, the contrast portion and the back portion meet a relation:

$$D2>D1$$

$$D2>D3$$

where D1 represents a width of the face portion in a in a front-and-back direction, D2 represents a width of the contrast portion in the front-and-back direction, and D3 represents a width of the back portion in the front-and-back direction.

11. The putter head according to claim 1, wherein the face portion, the contrast portion and the back portion meet a relation:

$$\rho 1>\rho 2$$

$$\rho 3>\rho 1$$

where ρ1 represents a specific gravity of a material of the face portion, ρ2 represents a specific gravity of a material of the contrast portion, and ρ3 represents a specific gravity of a material of the back portion.

12. The putter head according to claim 1, wherein a distance between the face surface of the face portion and a center of gravity of the putter head is equal to or larger than 20 mm.

13. A putter head comprising:

a face portion;

a contrast portion disposed adjacent to the face portion, wherein the contrast portion appears substantially transparent:

at least one first aiming, which appears substantially to a face surface of the face portion, the at least one aiming marker formed by a boundary between the face portion and the contrast portion;

wherein the face portion and the contrast portion meet a relation:

$$\rho 1>\rho 2$$

where ρ1 represents a specific gravity of a material of the face portion and ρ2 represents a specific gravity of a material of the contrast portion, wherein no opaque portion is present on each side of the contrast portion except a front side and a rear side of the contrast portion.

14. A putter head comprising:

a face portion;

at least one first aiming marker, which appears substantially parallel to a face surface of the face portion;

a contrast portion that substantially contrasts with the first aiming marker in appearance, wherein the contrast portion is disposed adjacent to the face portion, and the contrast portion is disposed behind the face portion; and a back portion disposed behind the contrast portion, wherein the face portion, the contrast portion and the back portion meet a relation:

$$\rho 1>\rho 2$$

$$\rho 3>\rho 1$$

where ρ1 represents a specific gravity of a material of the face portion, ρ2 represents a specific gravity of a material of the contrast portion, and ρ3 represents a specific gravity of a material of the back portion.

* * * * *